US010029892B2

(12) United States Patent
Ojapalo

(10) Patent No.: US 10,029,892 B2
(45) Date of Patent: Jul. 24, 2018

(54) HOISTING ROPE ARRANGEMENT IN CRANE TROLLEY

(71) Applicant: KONECRANES GLOBAL CORPORATION, Hyvinkää (FI)

(72) Inventor: Esa Ojapalo, Riihimäki (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 235 days.

(21) Appl. No.: 14/771,456

(22) PCT Filed: Feb. 27, 2014

(86) PCT No.: PCT/FI2014/050143

§ 371 (c)(1),
(2) Date: Aug. 28, 2015

(87) PCT Pub. No.: WO2014/131944

PCT Pub. Date: Sep. 4, 2014

(65) Prior Publication Data

US 2016/0002009 A1 Jan. 7, 2016

(30) Foreign Application Priority Data

Mar. 1, 2013 (FI) ..... 20135198

(51) Int. Cl.
*B66C 11/16* (2006.01)
*B66C 19/00* (2006.01)

(52) U.S. Cl.
CPC ..... *B66C 11/16* (2013.01); *B66C 19/00* (2013.01)

(58) Field of Classification Search
CPC ..... B66C 11/16; B66C 11/18; B66C 19/00; B66C 13/00
See application file for complete search history.

(56) References Cited

U.S. PATENT DOCUMENTS 3,994,401 A * 11/1976 Tax ..... B66C 11/16 212/228
6,250,486 B1 * 6/2001 Enoki ..... B66C 11/16 212/270
2005/0218100 A1 10/2005 Takehara et al.

FOREIGN PATENT DOCUMENTS

DE 102130 A1 12/1973
DE 3126205 A 1/1983
(Continued)

*Primary Examiner* — Minh Truong
*Assistant Examiner* — Juan J Campos, Jr.
(74) *Attorney, Agent, or Firm* — Birch, Stewart, Kolasch & Birch, LLP

(57) ABSTRACT

A hoisting rope arrangement in a trolley moving along a main girder of a crane and driven by an outside mechanism is provided. Both sides of the trolley are provided with successive rope pulley pairs located at a distance from one another in a longitudinal direction of the trolley and, below these, sheaves situated in a hoisting member, whereby on both sides of the trolley, a first hoisting rope is led from a first end of the main girder of the crane via one rope pulley of a first rope pulley pair down to the sheave and therefrom via an other rope pulley to a second end of the main girder, and a second hoisting rope is led from the second end of the main girder via one rope pulley of a second rope pulley pair down to the sheave and therefrom via an other rope pulley to the first end of the main girder. The arrangement employs rope pulley pairs which comprise differently sized rope pulleys but which are mounted in successive fastening points of the trolley such that they are reversed in relation to one another and such that in successive pulley pairs the differently sized rope pulleys are aligned with one another as viewed in the longitudinal direction of the trolley.

4 Claims, 2 Drawing Sheets

(56) References Cited

FOREIGN PATENT DOCUMENTS

Figure 1:
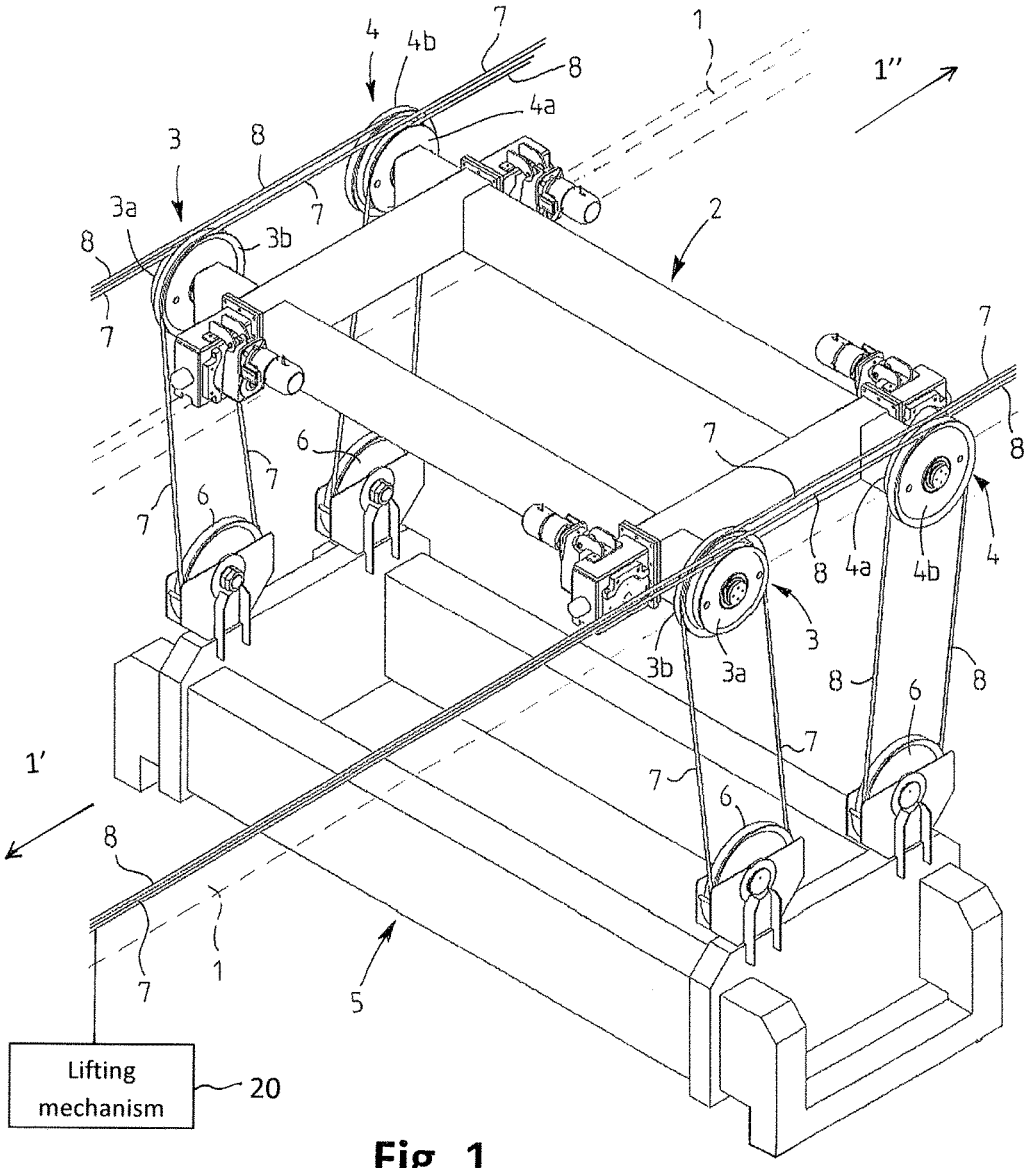

| | | | | |
|---|---|---|---|---|
| FR | 2.210.564 | A1 | | 7/1974 |
| GB | 1 209 263 | A | | 10/1970 |
| JP | 57-582 | U | | 1/1982 |
| JP | 01008195 | A | * | 1/1989 |
| JP | 2-243494 | A | | 9/1990 |
| JP | 11-217188 | A | | 8/1999 |
| JP | 11-246169 | A | | 9/1999 |
| SU | 1203010 | A1 | | 1/1986 |

* cited by examiner

HOISTING ROPE ARRANGEMENT IN CRANE TROLLEY

BACKGROUND OF THE INVENTION

The invention relates to a hoisting rope arrangement in a crane trolley, wherein the trolley is arranged to move on a main girder of the crane; a lifting mechanism of the trolley is located outside the trolley; both sides of the trolley are provided with successive rope pulley pairs located at a distance from one another in a longitudinal direction of the trolley and, below these, at a distance, sheaves situated in a hoisting member; whereby on both sides of the trolley, a first hoisting rope is led from a first end of the main girder of the crane via one rope pulley of a first rope pulley pair of the trolley down to the sheave located therebelow and therefrom via an other rope pulley of said rope pulley pair to a second end of the main girder; and on both sides of the trolley, a second hoisting rope is led from the second end of the main girder of the crane via one rope pulley of the second rope pulley pair of the trolley down to the sheave therebelow and therefrom via an other rope pulley of said rope pulley pair to the first end of the main girder.

Successive suspensions for hoisting ropes in the trolley should be made symmetrical so as to make a load to be distributed among the hoisting ropes as evenly as possible. When using a trolley wherein the lifting mechanism is located outside the trolley, the ropes are led to the hoisting member by running them via rope pulleys provided in the trolley. Typically, building a symmetrical rope suspension requires successive rope pulley pairs to be placed at different distances from the trolley so as to prevent the rope lines from coming into contact with one another. One such prior art solution is disclosed in document JP 1990243494A wherein hoisting ropes led to opposite sides of the crane then both run in parallel planes of their own, thus requiring space in the width direction. As viewed from above, the trolley and its rope pulley fastenings are not symmetrical, either.

SUMMARY OF THE INVENTION

An object of the invention is to improve the arrangement mentioned in the beginning so as to enable the aforementioned drawbacks to be solved. This object is achieved by the hoisting rope arrangement according to the invention, which is characterized in that each rope pulley pair comprises, arranged on the same axis, a rope pulley having a larger diameter and a rope pulley having a smaller diameter, whereby in each rope pulley pair said larger diameters correspond to one another and said smaller diameters correspond to one another; the rope pulley of the first rope pulley pair provided with the larger diameter is, as viewed in a longitudinal direction of the main girder and the trolley, aligned with the rope pulley of the second rope pulley pair provided with the smaller diameter; and the rope pulley of the first rope pulley pair provided with the smaller diameter is, as viewed in the longitudinal direction of the main girder and the trolley, aligned with the rope pulley provided with the larger diameter of the second rope pulley pair; the hoisting ropes in the trolley and the hoisting member being located symmetrically with respect to a transverse vertical plane passing in the middle of the trolley and the hoisting member and substantially in the same vertical planes in the direction of the main girder on different sides of the trolley at least in the vicinity of the trolley.

Preferred embodiments of the invention are disclosed in the dependent claims.

The invention is based on using, preferably, identical rope pulley pairs which comprise differently sized rope pulleys but which are mounted in successive fastening points of the trolley such that they are reversed in relation to one another and such that in successive pulley pairs the differently sized rope pulleys are aligned with one another as viewed in the longitudinal direction of the trolley. The rope lines between the trolley and the hoisting member can also be made symmetrical. At the same time, the entire structure becomes simpler.

LIST OF FIGURES

Figure 2:
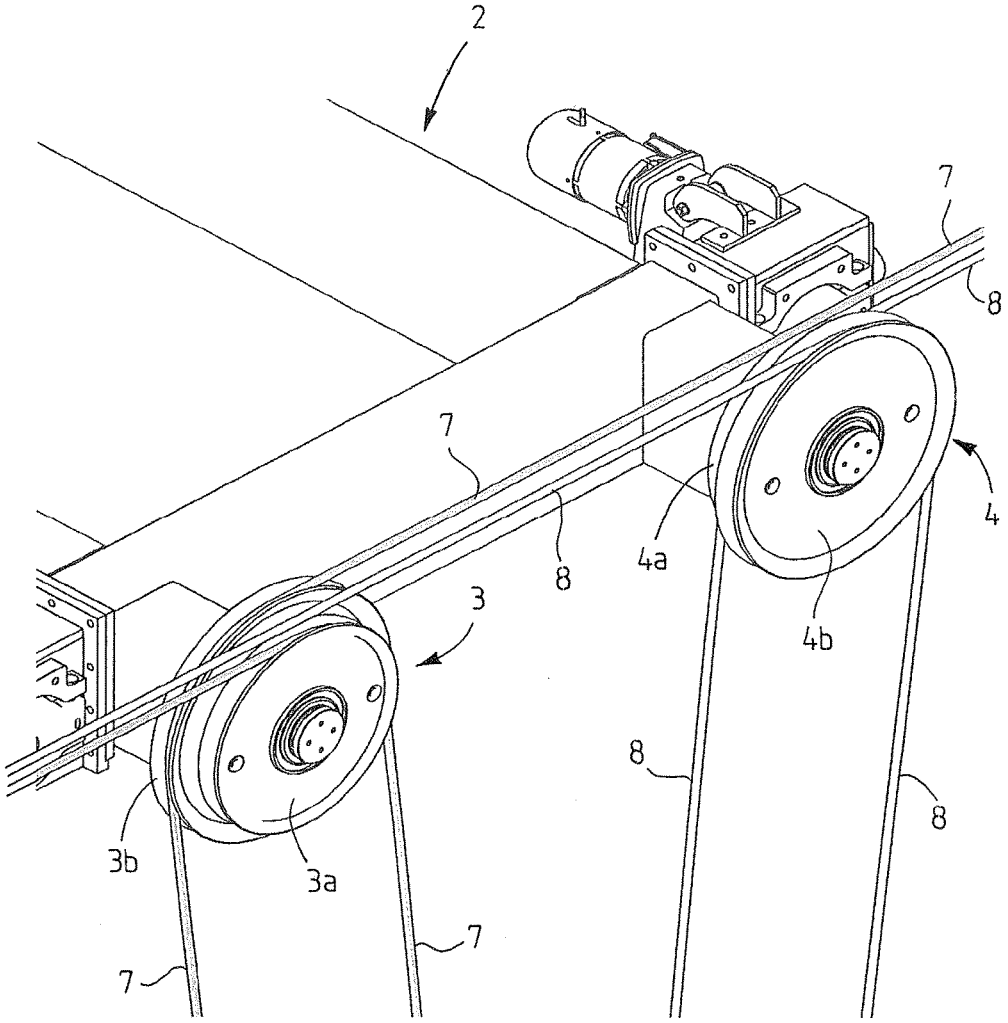

The invention is now described in closer detail by means of one preferred embodiment and with reference to the accompanying drawings, in which FIG. 1 shows a hoisting rope arrangement according to the invention; and FIG. 2 is a partial enlargement of FIG. 1 and particularly of rope pulley pairs.

DETAILED DESCRIPTION OF THE INVENTION

The figures show a crane, of which is seen its main girder comprising two parallel rails 1 along which a trolley 2 is arranged to move whose both sides are provided with successive rope pulley pairs 3 and 4 located at a distance from one another in a longitudinal direction of the trolley 2. Below the trolley 2, at a distance, is arranged a hoisting member 5 provided with a total of four sheaves 6 below the rope pulley pairs 3 and 4. A lifting mechanism or mechanisms 20 of the trolley 2 are located outside the trolley 2. From the lifting mechanism, hoisting ropes 7 and 8 are led from a first end 1' of the main girder to its second end 1" via the rope pulley pairs 3 and 4 of the trolley 2 and the sheaves 6 of the hoisting member 5.

To be more precise, on both sides of the trolley 2, a first hoisting rope 7 is led from the first end of the main girder 1 of the crane via one rope pulley 3*a* of a first rope pulley pair 3 of the trolley 2 down to the sheave 6 located therebelow and therefrom via the other rope pulley 3*b* of the rope pulley pair 3 to the second end of the main girder 1.

Correspondingly, on both sides of the trolley 2, a second hoisting rope 8 is led from the second end of the main girder 1 of the crane via one rope pulley 4*a* of a second rope pulley pair 4 of the trolley 2 down to the sheave 6 located therebelow and therefrom via the other rope pulley 4*b* of the rope pulley pair 4 to the first end of the main girder 1.

An essential point in this arrangement is that each rope pulley pair 3 and 4 comprises, arranged on the same axis, a rope pulley 3*b* and 4*b* having a larger diameter and a rope pulley 3*a* and 4*a* having a smaller diameter, whereby in each rope pulley pair 3 and 4 the larger diameters correspond to one another and the smaller diameters correspond to one another.

In such a case, the rope pulley 3*b* of the first rope pulley pair 3 provided with the larger diameter is, as viewed in a longitudinal direction of the main girder 1 and the trolley 2, aligned with the rope pulley 4*a* of the second rope pulley pair 4 provided with the smaller diameter.

Correspondingly, the rope pulley 3*a* of the first rope pulley pair 3 provided with the smaller diameter is, as viewed in the longitudinal direction of the main girder 1 and the trolley 2, aligned with the rope pulley 4*a* of the second rope pulley pair 4 provided with the larger diameter.

Thus, the hoisting ropes 7 and 8 in the trolley 2 and the hoisting member 5 are located symmetrically with respect to a transverse vertical plane passing in the middle of the trolley 2 and the hoisting member 5 and substantially in the same vertical planes in the direction of the main girder 1 on different sides of the trolley 2 at least in the vicinity of the trolley 2.

The rope pulleys 3*a*, 3*b* and 4*a*, 4*b* of each rope pulley pair 3 and 4 may be formed as separate rope pulleys pivotably mounted side by side on the same axle, preferably by using similar bearings.

Alternatively, the rope pulleys 3*a*, 3*b* and 4*a*, 4*b* of each rope pulley pair 3 and 4 may be formed as separate rope pulleys arranged in one another into one entity such that their mutual rotation is possible. An option is also to form the rope pulleys 3*a*, 3*b* and 4*a*, 4*b* of each rope pulley pair 3 and 4 as a uniform entity having two rope groove structures which have differently sized diameters and which may rotate with respect to one another. In these alternative embodiments, intermediate bearing is arranged between the parts rotating with respect to one another.

The rope pulleys 3*a*, 3*b*, and 4*a*, 4*b*, respectively, located on the same axle rotate in the same direction of rotation when the trolley 2 is driven in a direction parallel to the main girder 1. When, again, the hoisting member 5 is lifted or lowered, the rope pulleys 3*a*, 3*b*, and 4*a*, 4*b*, respectively, rotate in mutually opposite directions.

It is functional that the rope pulley pairs 3 and 4 are identical, but when placed successively in the trolley 2, they are placed reversely in relation to one another. The identical rope pulley pairs 3 and 4 enable all rope pulley pairs to be mutually replaceable, with only their mounting directions in the trolley 2 varying. Further advantages include benefits of manufacture: axle journals are mutually similar, and bearings preferably of one type may be used for all rope pulleys. All axles or projections supporting the axles may be made shorter, in which case the moments loading them at the base are smaller. Owing to the symmetry and the load being evenly distributed among the ropes, the hoisting ropes 7 and 8 may also be expected to wear down evenly.

The above description of the invention is only intended to illustrate the basic idea of the invention. A person skilled in the art may thus vary its details within the scope of the attached claims.

The invention claimed is:

1. A hoisting rope arrangement in a crane trolley, wherein:

the crane trolley is arranged to move on a main girder of a crane;

a lifting mechanism of the crane trolley is located outside the crane trolley;

both sides of the crane trolley are provided with successive rope pulley pairs located at a distance from one another in a longitudinal direction of the crane trolley and, below the successive rope pulley pairs, at a distance, sheaves situated in a hoisting member; whereby on both sides of the crane trolley, a first hoisting rope is led from a first end of the main girder of the crane via one rope pulley of a first rope pulley pair of the crane trolley down to the sheave located therebelow and therefrom via the other rope pulley of said first rope pulley pair to a second end of the main girder; and on both sides of the crane trolley, a second hoisting rope is led from the second end of the main girder of the crane via one rope pulley of a second rope pulley pair of the crane trolley down to the sheave located therebelow and therefrom via the other rope pulley of said second rope pulley pair to the first end of the main girder, wherein each rope pulley pair comprises, arranged on the same axle, a rope pulley having a larger diameter and a rope pulley having a smaller diameter, whereby in each rope pulley pair said larger diameters correspond to one another and said smaller diameters correspond to one another;

the rope pulley of the first rope pulley pair provided with the larger diameter is, as viewed in a longitudinal direction of the main girder and the crane trolley, aligned with the rope pulley of the second rope pulley pair provided with the smaller diameter;

the rope pulley of the first rope pulley pair provided with the smaller diameter is, as viewed in the longitudinal direction of the main girder and the crane trolley, aligned with the rope pulley of the second rope pulley pair provided with the larger diameter; and the hoisting ropes in the crane trolley and the hoisting member being located symmetrically with respect to a transverse vertical plane passing in the middle of the crane trolley and the hoisting member and substantially in the same vertical planes in the direction of the main girder on different sides of the crane trolley at least in the vicinity of the crane trolley.

2. The hoisting rope arrangement as claimed in claim 1, wherein the rope pulleys of each rope pulley pair are formed as separate rope pulleys pivotably mounted side by side on the same axle.

3. The hoisting rope arrangement as claimed in claim 1, wherein the rope pulley pairs are identical, but when placed successively in the crane trolley, they are placed reversely in relation to one another.

4. The hoisting rope arrangement as claimed in claim 1, wherein the sheaves of the hoisting member are mutually identical.

* * * * *